US009506666B2

(12) United States Patent
Rite

(10) Patent No.: US 9,506,666 B2
(45) Date of Patent: Nov. 29, 2016

(54) SYSTEM AND METHOD FOR MONITORING HVAC SYSTEM OPERATION

(71) Applicant: Trane International Inc., Piscataway, NJ (US)

(72) Inventor: Raymond Walter Rite, Tyler, TX (US)

(73) Assignee: Trane International Inc., Piscataway, NJ (US)

( * ) Notice: Subject to any disclaimer, the term of this patent is extended or adjusted under 35 U.S.C. 154(b) by 389 days.

(21) Appl. No.: 13/917,335

(22) Filed: Jun. 13, 2013

(65) Prior Publication Data

US 2014/0371917 A1 Dec. 18, 2014

(51) Int. Cl.
*F24F 11/00* (2006.01)

(52) U.S. Cl.
CPC ..... *F24F 11/001* (2013.01); *F24F 2011/0042* (2013.01); *F24F 2011/0091* (2013.01)

(58) Field of Classification Search
CPC . F24F 11/001; F24F 11/0042; F24F 11/0091
USPC ..... 700/276
See application file for complete search history.

(56) References Cited

U.S. PATENT DOCUMENTS

| | | | | |
|---|---|---|---|---|
| 5,410,230 | A | 4/1995 | Bessler et al. | |
| 6,577,962 | B1 * | 6/2003 | Afshari | 702/61 |
| 6,889,173 | B2 * | 5/2005 | Singh | 702/188 |
| 7,031,880 | B1 | 4/2006 | Seem et al. | |
| 7,072,727 | B1 * | 7/2006 | Davis | 700/97 |
| 7,113,086 | B2 | 9/2006 | Shorrock | |
| 7,200,468 | B2 * | 4/2007 | Ruhnke et al. | 700/300 |
| 7,331,852 | B2 | 2/2008 | Ezell et al. | |
| 7,640,077 | B2 | 12/2009 | Shah | |
| 7,682,234 | B1 | 3/2010 | Beitelmal et al. | |
| 7,729,882 | B2 | 6/2010 | Seem | |
| 7,941,294 | B2 | 5/2011 | Shahi et al. | |
| 8,011,199 | B1 | 9/2011 | Chen et al. | |
| 8,019,567 | B2 * | 9/2011 | Steinberg et al. | 702/130 |
| 8,091,794 | B2 | 1/2012 | Siddaramanna et al. | |
| 8,473,106 | B2 * | 6/2013 | Clark et al. | 700/276 |

(Continued)

FOREIGN PATENT DOCUMENTS

| | | | |
|---|---|---|---|
| EP | 2390832 | A2 | 11/2011 |
| WO | 2005050339 | A1 | 6/2005 |

OTHER PUBLICATIONS

Chamberlin, Glen A., et al., "Standard HVAC Control Systems Commissioning and Quality Verification User Guide," FEAP-UG-FE-94/20, User Guide, Sep. 1994, 127 pages.

*Primary Examiner* — Ben Rifkin
*Assistant Examiner* — Michael J Huntley
(74) *Attorney, Agent, or Firm* — Conley Rose, P.C.; J. Robert Brown, Jr.; Michael J. Schofield

(57) ABSTRACT

A comfort controller in an HVAC system is provided. The comfort controller comprises a processor configured such that the comfort controller compares at least one of an actual run time of the HVAC system to a benchmark run time and an actual static pressure of the HVAC system to a benchmark static pressure. The processor is further configured such that, when at least one of the actual run time and the actual static pressure are outside a specified range of their associated benchmarks, the comfort controller determines that the HVAC system has an improper configuration. The processor is further configured such that the comfort controller displays the results of the comparison.

14 Claims, 4 Drawing Sheets

(56) References Cited

U.S. PATENT DOCUMENTS

| | | | | |
|---|---|---|---|---|
| 8,613,792 | B2 * | 12/2013 | Ragland et al. | 95/25 |
| 8,623,117 | B2 * | 1/2014 | Zavodny et al. | 95/25 |
| 8,682,491 | B2 * | 3/2014 | Fakos et al. | 700/276 |
| 8,734,565 | B2 * | 5/2014 | Hoglund et al. | 95/25 |
| 8,924,026 | B2 * | 12/2014 | Federspiel et al. | 700/276 |
| 2004/0239494 | A1 | 12/2004 | Kennedy et al. | |
| 2008/0027568 | A1 * | 1/2008 | Pearson | 700/80 |
| 2009/0099814 | A1 | 4/2009 | Scott | |
| 2010/0298984 | A1 | 11/2010 | Mauk et al. | |
| 2011/0106314 | A1 | 5/2011 | Beitelmal et al. | |
| 2011/0155354 | A1 | 6/2011 | Karamanos et al. | |
| 2012/0022700 | A1 * | 1/2012 | Drees | G05B 15/02 700/276 |
| 2012/0071082 | A1 | 3/2012 | Karamanos | |
| 2012/0072029 | A1 * | 3/2012 | Persaud et al. | 700/276 |
| 2012/0221150 | A1 * | 8/2012 | Arensmeier | 700/276 |
| 2012/0323374 | A1 * | 12/2012 | Dean-Hendricks et al. | 700/276 |
| 2012/0323375 | A1 * | 12/2012 | Dean-Hendricks et al. | 700/276 |
| 2012/0323377 | A1 * | 12/2012 | Hoglund et al. | 700/277 |
| 2014/0107851 | A1 * | 4/2014 | Yoon et al. | 700/291 |
| 2014/0257575 | A1 * | 9/2014 | Roy | 700/276 |
| 2014/0277762 | A1 * | 9/2014 | Drew | 700/276 |

* cited by examiner

SYSTEM AND METHOD FOR MONITORING HVAC SYSTEM OPERATION

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND

A heating, ventilation, and air conditioning (HVAC) system for a home may consist of a plurality of factory-engineered components, such as outdoor condensing units, air handlers, cased-coils, furnaces, and air filtering systems. Such a system may also contain components unique to each home, such as ductwork, dampers, and discharge grills. In addition, a home served by such a system may contain unique architectural, construction, and site features, such as the square footage, design, and location of the home, the insulation used in the home, the exposure of the home to solar loading, and the lifestyle of the homeowner. All such features typically need to be considered when the components of a residential HVAC system are selected.

SUMMARY

In some embodiments of the disclosure, a comfort controller in an HVAC system is provided. The comfort controller comprises a processor configured such that the comfort controller compares at least one of an actual run time of the HVAC system to a benchmark run time and an actual static pressure of the HVAC system to a benchmark static pressure. The processor is further configured such that, when at least one of the actual run time and the actual static pressure are outside a specified range of their associated benchmarks, the comfort controller determines that the HVAC system has an improper configuration. The processor is further configured such that the comfort controller displays the results of the comparison.

In other embodiments of the disclosure, a method for determining the installation quality of an HVAC system is provided. The method comprises at least one of comparing an actual run time of the HVAC system to a benchmark run time and comparing an actual static pressure of the HVAC system to a benchmark static pressure. The method further comprises, when the actual run time is outside a specified range of the benchmark run time, determining that the HVAC system has an improper size. The method further comprises, when the actual static pressure is outside a specified range of the benchmark static pressure, determining that an improper configuration exists in at least one of the ductwork of the HVAC system and a filter in the HVAC system. The method further comprises, displaying the results of the comparison.

In still other embodiments of the disclosure, an HVAC system is provided. The HVAC system comprises a comfort controller, a sensor, and a memory location. The comfort controller is configured to compare an actual run time of the HVAC system to a benchmark run time, further configured to determine, when the actual run time is outside a specified range of the benchmark run time, that the HVAC system has an improper size, and further configured to display the results of the comparison in a report card that is displayed on at least one of the comfort controller or a device in a network to which the comfort controller is connected. The sensor is configured to provide the actual run time to the comfort controller. The comfort controller is capable of retrieving the benchmark run time from the memory location.

BRIEF DESCRIPTION OF THE DRAWINGS

For a more complete understanding of the present disclosure and the advantages thereof, reference is now made to the following brief description, taken in connection with the accompanying drawings and detailed description, wherein like reference numerals represent like parts.

DETAILED DESCRIPTION

The components of an HVAC system may be subject to rigorous engineering design processes and may comply with accepted industry and government standards for safety, performance, reliability, and energy efficiency. However, these best practices may be futile if failures occur during the selection, installation, or operational life of the system. Such failures may include poor system sizing, poor duct design or installation, improper selection of control settings on the system, and poor system maintenance. Any such defect in an HVAC system may be referred to herein as an improper configuration of the system.

Embodiments of the present disclosure provide a systematic methodology and objective means for rating the selection, installation, and operation of components in a home's HVAC system. The homeowner may be continually informed of changes in the integrity and performance of the system throughout the life of the system. The financial impact of the cost of poor operation of the system may also be provided. The embodiments disclosed herein do not require any additional sensors other than those typically provided with a conventional HVAC system that is equipped to provide information on run time, air delivery, static pressure, and input power.

In addition, a quality report card is disclosed herein that provides an objective means for evaluating a system's integrity and performance parameters. The report card uses feedback from the components of an HVAC system to assess both the initial commissioning of the system and the operation of the system throughout its life cycle. The inputs that are used in creating the report card may include a record of operation run time and associated factors such as the outdoor ambient temperature, the indoor temperature set point, and the performance characteristics reported by the indoor airflow controller.

Figure 1:
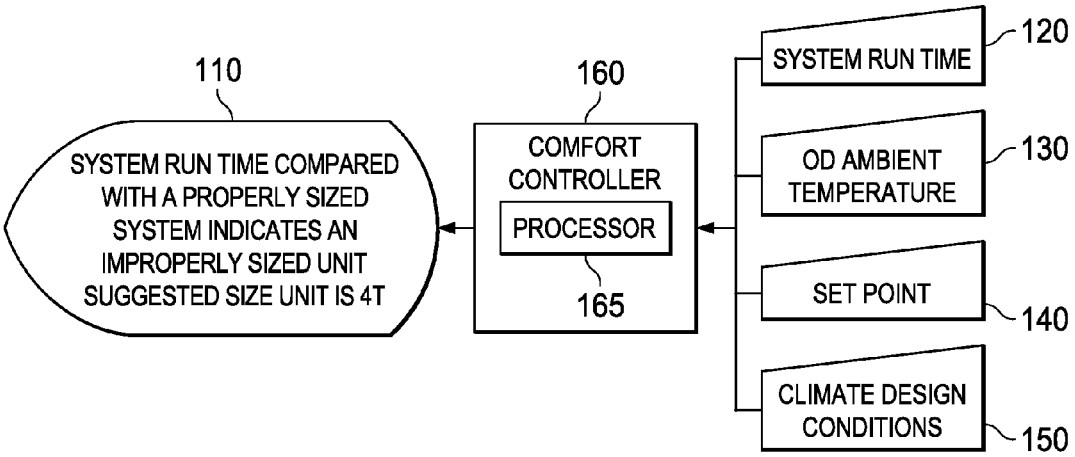
FIG. 1 is a flow chart for the creation of a report card for an HVAC system according to an embodiment of the disclosure.

FIG. 1 illustrates an embodiment of a high-level flow chart for the creation of such a report card 110 for an HVAC system. Inputs such as the system run time 120, the outdoor ambient temperature 130, the indoor temperature set point 140, the climate design conditions 150, the operation history of the system, and other performance characteristics of the system are provided to a comfort controller 160. Any thermostat or similar HVAC system controller that has digital data processing capabilities will be referred to herein as a comfort controller. The comfort controller 160 may include a processor 165 and associated data processing hardware and software that together allow the comfort controller 160 to accept and process digital inputs and produce appropriate outputs. Any actions described herein as being taken by the comfort controller 160 may be understood as being taken by the processor 165 and associated components.

In an alternative embodiment, rather than the processor 165 being physically located in the comfort controller 160, as shown in FIG. 1, the processor 165 may be located remotely from the comfort controller 160. For example, data collected by the comfort controller 160 may be transmitted via a network to a computing system in the network. In this case, the processor 165 may be a component in such a computing system. Such a remote processor 165 may process data received from the comfort controller 160 and return processed data to the comfort controller 160. Thus, a processor described herein as a component in the comfort controller 160 or a component in an HVAC system may be physically located outside the comfort controller 160 and/or outside the components that typically form an HVAC system.

The comfort controller 160 receives the inputs described above and compares the operating characteristics of the system in question to the operation of an optimized system that has been properly selected and installed. Such an optimized system may be referred to herein as a benchmark system, and components or parameters associated with a benchmark system may be referred to as benchmark components or parameters. Run times may be normalized based on local climate design conditions available from various sources. These operating characteristics may be accessed by the comfort controller 160 and interpreted shortly after installation of the HVAC system.

In an embodiment, the 99% design condition for cooling and heating is used to make an evaluation of system sizing. According to accepted practice, a cooling system is typically sized such that, at the 99% design condition, the system runs continually. For example, a 1% cooling design temperature of 98° F. for a particular city means that, based on historic data, the annual cumulative frequency of occurrence of dry bulb temperatures greater than 98° F. in that city is 1%. When the ambient temperature is at or above this point, a cooling system may be expected to have a high run time. If the run time is significantly lower than expected and no special cases are identified, such as the indoor temperature setting being increased while the homeowner is away, the system may be considered oversized.

In an embodiment, the comfort controller 160 compares the actual run time of an HVAC system to the run time that is expected for a benchmark system under the current conditions. The comfort controller 160 then generates the report card 110 based on the comparison. If the actual run time is within a specified range of the expected run time, the report card 110 may indicate that the system has been sized and installed properly. If the actual run time is a specified length of time greater than the expected run time, the report card 110 may indicate that the system is undersized and/or that the system has not been installed properly. If the actual run time is a specified length of time less than the expected run time, the report card 110 may indicate that the system is oversized.

It should be understood that, as used herein, the term "report card" does not necessarily refer to a paper document traditionally used in an educational environment. In some embodiments, the report card 110 may be information that is displayed on a display screen on the comfort controller 160. In other embodiments, the report card 110 may be information that is transmitted to a computer network or a telecommunications network for display on a device in the network. For example, the information in the report card 110 may be sent to an application on a computer in a computer network, and the application may cause the information in the report card 110 to be displayed on the computer's monitor. Alternatively, the information in the report card 110 may be sent to an email program resident on the computer. As another alternative, the information in the report card 110 may be sent as a text message or similar message to a wireless telecommunications device. As yet another alternative, the information in the report card 110 may be sent to a company that installed the HVAC system or to a similar entity, and this other entity, rather than the homeowner, may view and interpret the report card 110. One of skill in the art will recognize that the report card 110 may be any such display of information, as disclosed herein, related to the operating characteristics of an HVAC system.

In an embodiment, in addition to indicating whether or not an HVAC system is sized properly, the report card 110 may suggest a proper size for an improperly sized system. That is, the comfort controller 160 may be aware of the size of the system currently in use in a home and of a plurality of system sizes provided by the system manufacturer. When the size of the system currently in use is determined to be inappropriate, the comfort controller 160 may select one of the other available sizes that is deemed to be the most appropriate for the home. The comfort controller 160 may then display the selected size in the report card 110.

Figure 2:
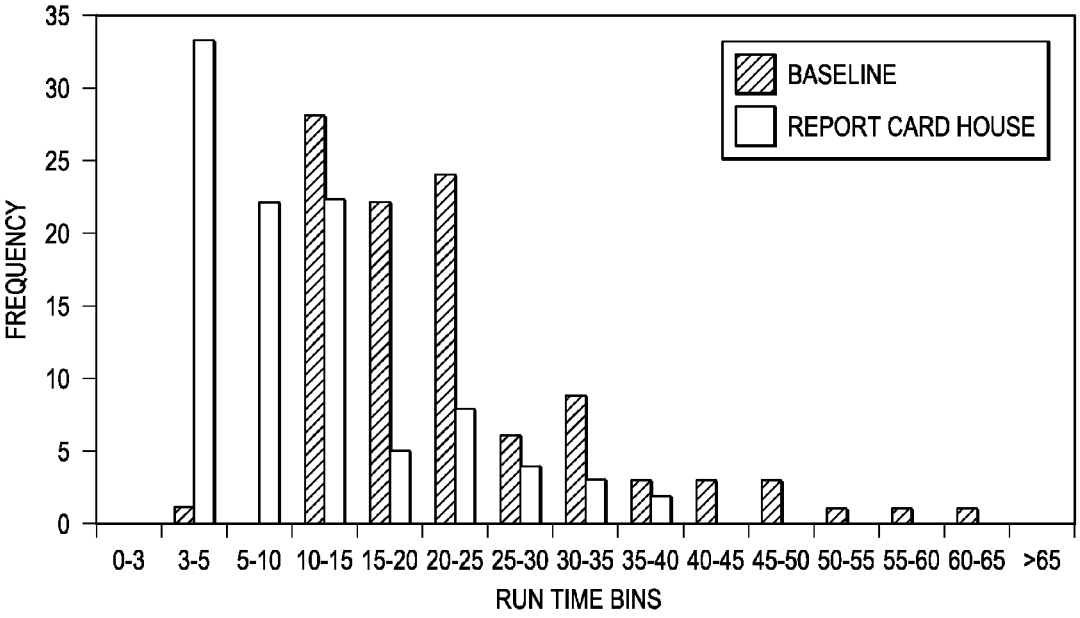
FIG. 2 illustrates a technique for characterizing run times for an HVAC system according to an embodiment of the disclosure.

FIG. 2 provides an example of a technique for characterizing run times for a range of conditions. In this example, a histogram of "on" times over a specified period of time has been made, and the run times are categorized into five-minute bins. The actual run time information may be provided by a sensor that has been installed in the HVAC system for collecting such information. It can be seen that a significant amount of short-cycle run time has been accumulated compared to a baseline, which is indicative of an oversized system. That is, in the three-to-five minute and five-to-ten minute bins, the actual run times are significantly greater than the expected run times. This indicates that the system is cycling on and off frequently and thus is likely to be oversized. Conversely, for an undersized system, long run times or an inability to reach a desired set point may occur even for relatively mild conditions and set points.

A baseline may be arrived at in several ways including but not limited to utilizing the industry standard methodology for performance rating of unitary air conditioners and air-source heat pumps. This standard assumes that the cooling and heating design requirement or building load is the capacity of the system at a rating point. This assumption of a system sized to load perfectly is then used to determine the building load at temperatures below the rating condition for cooling or above the rating condition for heating based on a balance point of 65° F., which may be the temperature above which cooling is required and below which heating is required. This "part" load may then be used to calculate an ideal run time by integrating the building load requirement over time in a given temperature bin and dividing by the system capacity. In order to utilize this methodology for a particular application, adjustments may need to be made to the system capacity based on indoor conditions and indoor airflow to account for latent load variation. This may be done with available simulation models for each outdoor and indoor equipment match. A baseline run time determined in such a manner may be stored in a memory location accessible to the comfort controller 160, and the comfort controller 160 may retrieve the baseline run time from the memory location for comparison with the actual run time.

After sufficient run time has accumulated and benchmark data has been collected for the system in question, any significant deviation from the benchmark, such as increased run times not related to the outdoor temperature or the indoor temperature set point, may be detected and recorded. The fact that the actual run time differs significantly from the benchmark may be reported to the homeowner in the form of the report card 110 to provide a notice of maintenance or replacement needs.

In an embodiment, the comfort controller 160 may determine the amount of electricity being wasted by an improperly sized system. That is, the comfort controller 160 may determine the difference between the amount of electricity actually being used by the system and the amount of electricity expected to be used by a benchmark system. This amount of excessive energy being used may be reported in the report card 110.

In an embodiment, the comfort controller 160 may have access to information regarding energy costs, such as the price per kilowatt-hour for electricity, at the home in which the comfort controller 160 is installed. The comfort controller 160 may combine the cost of electricity with the amount of electricity determined to be wasted by an improperly sized system to generate an estimate of the amount of money being wasted by operating a system that has a less than optimal sizing. Such a forecast of the financial impact that may result from failing to address the system operation issues may be included in the report card 110.

In addition to or as an alternative to the run time analysis disclosed above, the integrity and performance of an HVAC system may be evaluated based on the performance characteristics of components in the system. As part of the product design process, the performance characteristics of variable speed motors applied in air handling devices may be characterized. These characteristics may be programmed into the control logic of each air handler/motor assembly. In an embodiment, such characteristics, including but not limited to fan static pressure and input power, are used to evaluate system performance. The results of the evaluation may then be used to inform the homeowner or the system installer of the performance of the specific indoor equipment in the home.

More specifically, during operation of a variable speed indoor blower motor, a request may be provided by the comfort controller 160 to the motor control to have the motor operate at a particular airflow. Based on this air flow command and prior knowledge of the performance of the blower in the indoor product application, the external fan static pressure and the input power may be known at a given motor speed. In an embodiment, the comfort controller 160 may compare the actual fan static pressure to known standard values of external static pressure that would be expected when the ductwork of a particular system is performing acceptably. If the actual static pressure is outside a specified range of the benchmark static pressure, a deficiency in the home's ductwork may be indicated. Such a deviation from the benchmark may additionally or alternatively indicate a deficiency in the air filter in the system. Any deviation of the actual static pressure from the benchmark static pressure may be reported in the report card 110.

Additionally, the input power reported to the comfort controller 160 may be used along with the prevailing electrical energy costs to provide an estimate of the financial impact of operating the system with a non-optimum static pressure. That is, if the fan speed needs to be increased to compensate for a static pressure that differs from the benchmark, the increase in fan speed will result in increased power usage, which in turn will result in increased electricity costs. In an embodiment, the comfort controller 160 uses the actual and benchmark static pressure information and the energy cost information to estimate the cost of operating the system with a static pressure that deviates from the benchmark. Such a cost estimate may be displayed in the report card 110. This information may allow the homeowner or installer to determine the payback of modifying the existing ductwork in the home to address its deficiencies. This process may occur automatically during the installation and commissioning process.

Figure 3:
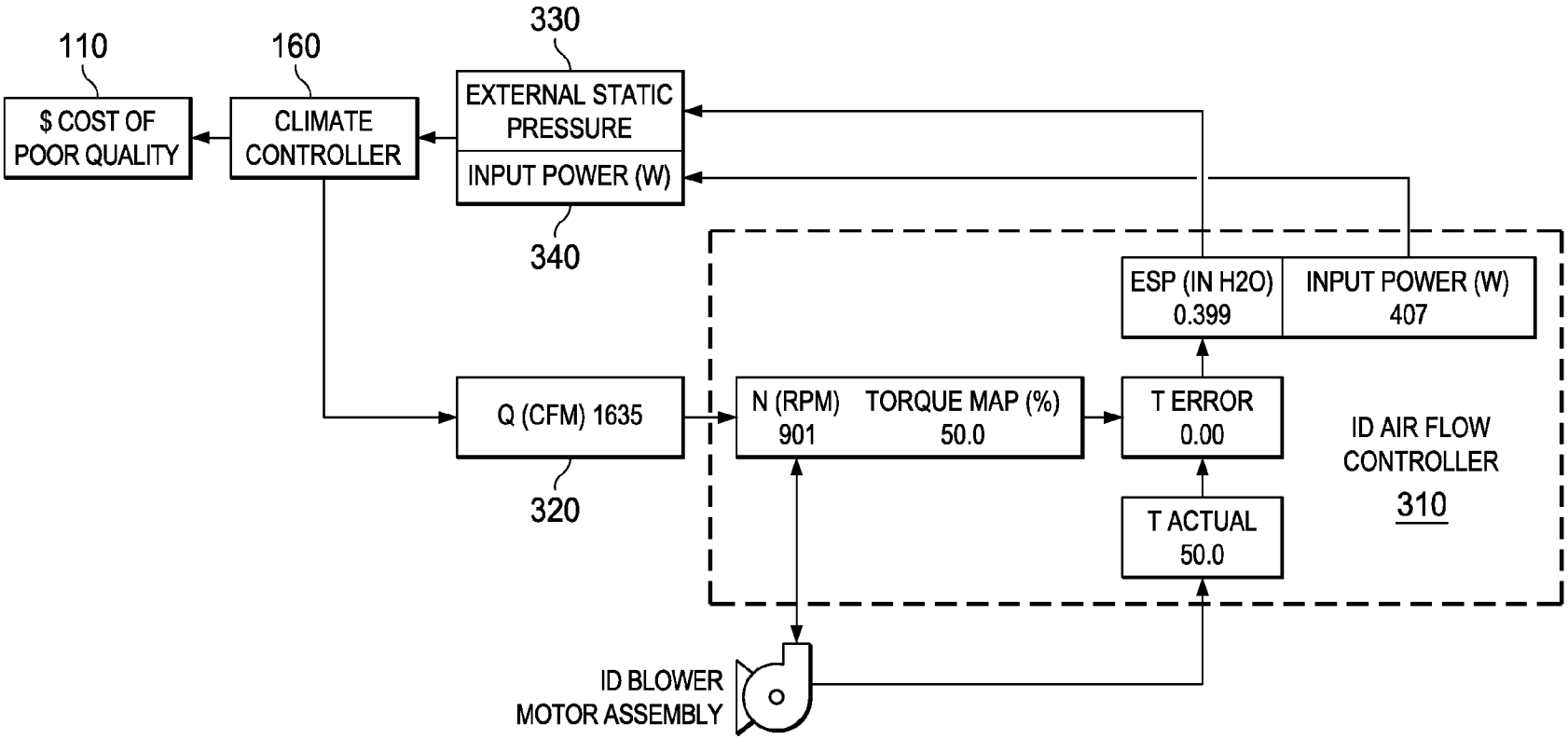
FIG. 3 is a schematic view of an HVAC system illustrating components that may be used in generating a report card for the system according to an embodiment of the disclosure.

FIG. 3 is a flow chart showing an embodiment of an interaction between the comfort controller 160, referred to in the drawing as a climate controller, and an indoor air flow controller 310. The comfort controller 160 requests an airflow 320, and an indoor fan motor controller reports back a static pressure 330 and an input power 340. The comfort controller 160 then uses these inputs to determine the status of the filter and the duct static pressure. The status of the filter and the duct static pressure may then be provided to the homeowner in the report card 110. Such information may be included in the reports card 110 on a continuing basis from both a qualitative and quantitative cost basis.

Figure 4A:
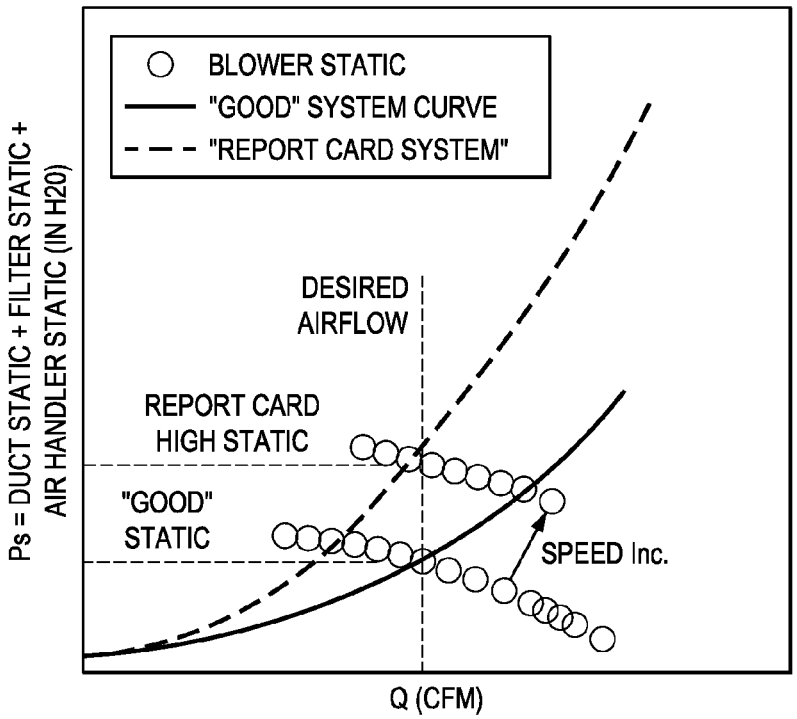
FIG. 4*a* illustrates blower static pressure curves according to an embodiment of the disclosure.
Figure 4B:
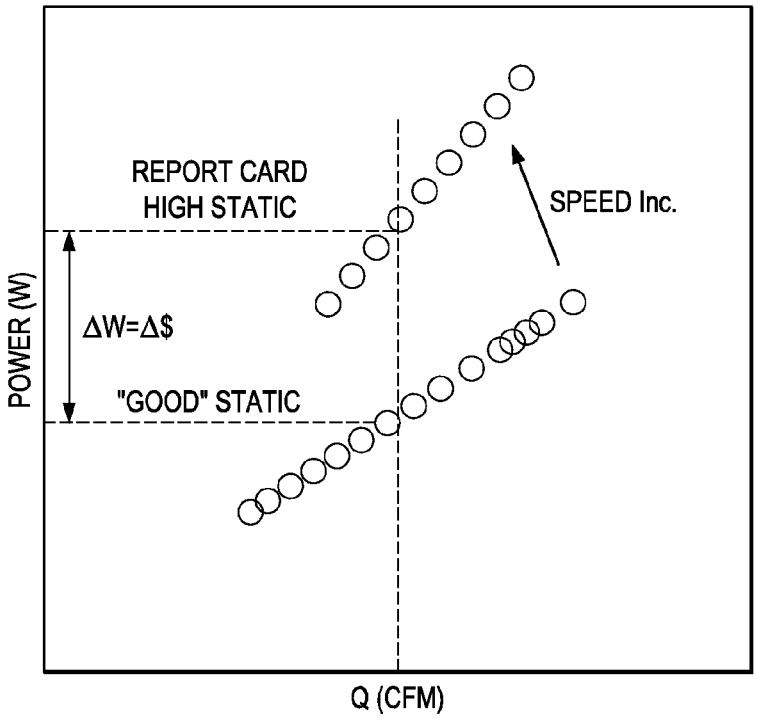
FIG. 4*b* illustrates power curves according to an embodiment of the disclosure.

Examples of blower static pressure curves and power curves are shown in FIGS. 4*a* and 4*b*. The characteristic or "good" curves are derived from the fan laws used to characterize air moving devices and are experimentally determined. The report card curves are determined as described herein. In FIG. 4*a*, fan curves are shown. When a request is made for a particular airflow rate, the blower motor sets the blower speed to achieve the requested rate. If the report card system curve is higher, due to high duct pressure for example, the blower speed may need to increase. In FIG. 4*b*, it can be seen that this increased speed results in increased power consumption and cost.

In an embodiment, either or both of these parameters, fan static pressure and input power, may be used to provide ongoing system health monitoring and continual feedback on any changes to the system. Such changes, depending on their nature and magnitude, may be indicative of fouled air filters, reduced airflow through coils, and/or leaks in the duct system. Thus, the use of real-time static pressure feedback from the air flow controller may allow decisions to be made based on the actual operating conditions currently being experienced by the HVAC system. By contrast, existing residential applications that indicate when an air filter requires replacement are based on generic timers that are not responsive to individual application characteristics.

Figure 5:
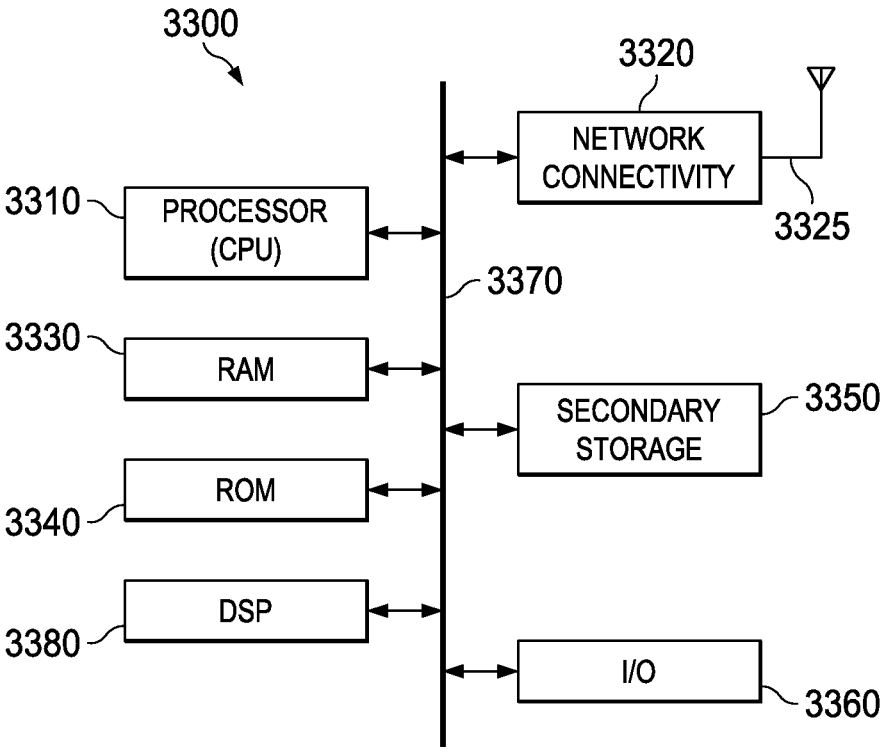
FIG. 5 illustrates a processor and related components suitable for implementing the several embodiments of the disclosure.

The comfort controller 160 might include or have access to a processing component that is capable of executing instructions related to the actions described above. FIG. 5 illustrates an example of a system 3300 that includes a processing component 3310 suitable for implementing one or more embodiments disclosed herein. The processing component 3310 may be substantially similar to the processor 165 of FIG. 1. It should be understood that all of the components illustrated in FIG. 5 are not necessarily present in the comfort controller 160 and that FIG. 5 is merely intended to illustrate some of the components that may be involved in the processing steps that are disclosed herein as being taken by the comfort controller 160.

In addition to the processor 3310 (which may be referred to as a central processor unit or CPU), the system 3300 might include network connectivity devices 3320, random access memory (RAM) 3330, read only memory (ROM) 3340, secondary storage 3350, and input/output (I/O) devices 3360. These components might communicate with one another via a bus 3370. In some cases, some of these components may not be present or may be combined in various combinations with one another or with other components not shown. These components might be located in a single physical entity or in more than one physical entity. Any actions described herein as being taken by the processor 3310 might be taken by the processor 3310 alone or by the processor 3310 in conjunction with one or more components shown or not shown in the drawing, such as a digital signal processor (DSP) 3380. Although the DSP 3380 is shown as a separate component, the DSP 3380 might be incorporated into the processor 3310.

The processor 3310 executes instructions, codes, computer programs, or scripts that it might access from the network connectivity devices 3320, RAM 3330, ROM 3340, or secondary storage 3350 (which might include various disk-based systems such as hard disk, floppy disk, or optical disk). While only one CPU 3310 is shown, multiple processors may be present. Thus, while instructions may be discussed as being executed by a processor, the instructions may be executed simultaneously, serially, or otherwise by one or multiple processors. The processor 3310 may be implemented as one or more CPU chips.

The network connectivity devices 3320 may take the form of modems, modem banks, Ethernet devices, universal serial bus (USB) interface devices, serial interfaces, token ring devices, fiber distributed data interface (FDDI) devices, wireless local area network (WLAN) devices, radio transceiver devices such as code division multiple access (CDMA) devices, global system for mobile communications (GSM) radio transceiver devices, universal mobile telecommunications system (UMTS) radio transceiver devices, long term evolution (LTE) radio transceiver devices, worldwide interoperability for microwave access (WiMAX) devices, and/or other well-known devices for connecting to networks. These network connectivity devices 3320 may enable the processor 3310 to communicate with the Internet or one or more telecommunications networks or other networks from which the processor 3310 might receive information or to which the processor 3310 might output information. The network connectivity devices 3320 might also include one or more transceiver components 3325 capable of transmitting and/or receiving data wirelessly.

The RAM 3330 might be used to store volatile data and perhaps to store instructions that are executed by the processor 3310. The ROM 3340 is a non-volatile memory device that typically has a smaller memory capacity than the memory capacity of the secondary storage 3350. ROM 3340 might be used to store instructions and perhaps data that are read during execution of the instructions. Access to both RAM 3330 and ROM 3340 is typically faster than to secondary storage 3350. The secondary storage 3350 is typically comprised of one or more disk drives or tape drives and might be used for non-volatile storage of data or as an over-flow data storage device if RAM 3330 is not large enough to hold all working data. Secondary storage 3350 may be used to store programs that are loaded into RAM 3330 when such programs are selected for execution.

The I/O devices 3360 may include liquid crystal displays (LCDs), touch screen displays, keyboards, keypads, switches, dials, mice, track balls, voice recognizers, card readers, paper tape readers, printers, video monitors, or other well-known input/output devices. Also, the transceiver 3325 might be considered to be a component of the I/O devices 3360 instead of or in addition to being a component of the network connectivity devices 3320.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A comfort controller in an HVAC system, the comfort controller comprising:

a processor configured to:

receive actual run time length information from a sensor installed in the HVAC system;

compare (1) a frequency of actual run time lengths of the HVAC system to a frequency of corresponding benchmark run time lengths and (2) an actual static pressure of the HVAC system to a benchmark static pressure;

determine that the HVAC system has an improper configuration when at least one of the frequency of actual run time lengths and the actual static pressure are outside a specified range of their associated benchmarks;

calculate an amount of excessive electricity used during the actual run time lengths compared to an amount of electricity expected to be used during the corresponding benchmark run time lengths when the frequency of actual run time lengths is greater than the frequency of corresponding benchmark run time lengths;

calculate a cost of using the excessive electricity using the calculated amount of excessive electricity and a known cost of electricity; and display in a report card the results of the comparison and at least one of the amount of excessive electricity and the cost of using the excessive electricity on at least one of the comfort controller and a device in a network to which the comfort controller is connected.

2. The comfort controller of claim 1, wherein, when the frequency of actual run time lengths is outside a specified range of the frequency of corresponding benchmark run time lengths, the comfort controller determines that the HVAC system has an improper size.

3. The comfort controller of claim 2, wherein, when the frequency of actual run time lengths is outside the specified range of the frequency of corresponding benchmark run time lengths, the comfort controller determines an appropriate size for the HVAC system and displays the appropriate size in the report card.

4. The comfort controller of claim 1, wherein, when the actual static pressure is outside a specified range of the benchmark static pressure, the comfort controller determines that an improper configuration exists in at least one of the ductwork of the HVAC system and a filter in the HVAC system, and wherein the comfort controller displays in the report card information indicating that the improper configuration exists.

5. The comfort controller of claim 4, wherein, when an actual fan speed is greater than a benchmark fan speed due to the actual static pressure being different from the benchmark static pressure, the comfort controller calculates an amount of excessive electricity used as a result of the increased fan speed, and wherein the comfort controller uses the calculated amount of excessive electricity and a known cost of electricity to calculate a cost of using the excessive electricity, and wherein the comfort controller displays in the report card the cost of using the excessive electricity.

6. A method for determining the installation quality of an HVAC system, the method comprising:

monitoring actual run time length information of the HVAC system using a sensor installed in the HVAC system;

comparing a frequency of actual run time lengths of the HVAC system to a frequency of corresponding benchmark run time lengths and comparing an actual static pressure of the HVAC system to a benchmark static pressure;

when the frequency of actual run time lengths is outside a specified range of the frequency of corresponding benchmark run time lengths, determining that the HVAC system has an improper size and calculating an amount of excessive electricity used over the actual run time lengths compared to an amount of electricity expected to be used over the corresponding benchmark run time lengths;

when the actual static pressure is outside a specified range of the benchmark static pressure, determining that an improper configuration exists in at least one of the ductwork of the HVAC system and a filter in the HVAC system; and displaying in a report card the results of the comparison and the amount of excessive electricity on at least one of a comfort controller that controls the HVAC system and a device in a network to which the comfort controller is connected.

7. The method of claim 6, further comprising:

using the calculated amount of excessive electricity and a known cost of electricity to calculate a cost of using the excessive electricity; and displaying in the report card the cost of using the excessive electricity.

8. The method of claim 6, further comprising:

when the frequency of actual run time lengths is outside the specified range of the frequency of corresponding benchmark run time lengths, determining an appropriate size for the HVAC system; and displaying the appropriate size in the report card.

9. The method of claim 6, further comprising:

when an actual fan speed is greater than a benchmark fan speed due to the actual static pressure being different from the benchmark static pressure, calculating an amount of excessive electricity used as a result of the increased fan speed;

using the calculated amount of excessive electricity and a known cost of electricity to calculate a cost of using the excessive electricity; and displaying in the report card the cost of using the excessive electricity.

10. An HVAC system comprising:

a comfort controller configured to:

compare a frequency of actual run time lengths of the HVAC system to a frequency of corresponding benchmark run time lengths;

determine, when the frequency of actual run time lengths is outside a specified range of the frequency of corresponding benchmark run time lengths, that the HVAC system has an improper size;

calculate, when the frequency of actual run time lengths is outside a specified range of the frequency of corresponding benchmark run time lengths, an amount of excessive electricity used over the actual run time lengths compared to an amount of electricity expected to be used over the corresponding benchmark run time lengths;

display the results of the comparison and the amount of excessive electricity in a report card that is displayed on at least one of the comfort controller or a device in a network to which the comfort controller is connected;

a sensor installed in the HVAC system and configured to provide the actual run time length to the comfort controller; and a memory location from which the comfort controller retrieves the benchmark run time lengths.

11. The HVAC system of claim 10, wherein the comfort controller uses the calculated amount of excessive electricity and a known cost of electricity to calculate a cost of using the excessive electricity, and wherein the comfort controller displays in the report card the cost of using the excessive electricity.

12. The HVAC system of claim 10, wherein, when the frequency of actual run time lengths is outside the specified range of the frequency of corresponding benchmark run time lengths, the comfort controller determines an appropriate size for the HVAC system and displays the appropriate size in the report card.

13. The HVAC system of claim 10, wherein the comfort controller compares an actual static pressure of the HVAC system to a benchmark static pressure, and wherein, when the actual static pressure is outside a specified range of the benchmark static pressure, the comfort controller determines that an improper configuration exists in at least one of the ductwork of the HVAC system and a filter in the HVAC system, and wherein the comfort controller displays in the report card information indicating that the improper configuration exists.

14. The HVAC system of claim 13, wherein, when an actual fan speed is greater than a benchmark fan speed due to the actual static pressure being different from the benchmark static pressure, the comfort controller calculates an amount of excessive electricity used as a result of the increased fan speed, and wherein the comfort controller uses the calculated amount of excessive electricity and a known cost of electricity to calculate a cost of using the excessive electricity, and wherein the comfort controller displays in the report card the cost of using the excessive electricity.

* * * * *